US009337563B2

(12) United States Patent
Takahashi

(10) Patent No.: US 9,337,563 B2
(45) Date of Patent: May 10, 2016

(54) HOLDER ASSEMBLY FOR RELAY CONNECTOR

(71) Applicant: YAZAKI CORPORATION, Tokyo (JP)

(72) Inventor: Takakazu Takahashi, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/444,222

(22) Filed: Jul. 28, 2014

(65) Prior Publication Data

US 2015/0031244 A1 Jan. 29, 2015

(30) Foreign Application Priority Data

Jul. 29, 2013 (JP) ..... 2013-156968

(51) Int. Cl.
*H01R 13/504* (2006.01)
*H01R 13/426* (2006.01)

(52) U.S. Cl.
CPC ..... *H01R 13/504* (2013.01); *H01R 13/426* (2013.01)

(58) Field of Classification Search
USPC ..... 439/626, 687, 606, 598, 595.752
See application file for complete search history.

(56) References Cited

U.S. PATENT DOCUMENTS 9,004,942 B2 * 4/2015 Paniagua ..... 439/607.07
2010/0297864 A1 11/2010 Matsuoka

FOREIGN PATENT DOCUMENTS

| | | | |
|---|---|---|---|
| CN | 101299506 | A | 11/2008 |
| JP | 6203888 | A | 7/1994 |
| JP | 2010-272354 | A | 12/2010 |
| JP | 2012-164520 | A | 8/2012 |
| KR | 1020110012013 | A | 2/2011 |

OTHER PUBLICATIONS

Office Action dated Aug. 17, 2015, issued by the Korean Intellectual Property Office in counterpart Korean Application No. 10-2014-0096365.

Communication issued Jan. 29, 2016, issued by the State Intellectual Property Office of the People's Republic of China in counterpart Chinese Patent Application No. 201410367443.4.

* cited by examiner

*Primary Examiner* — Alexander Gilman
(74) *Attorney, Agent, or Firm* — Sughrue Mion, PLLC

(57) ABSTRACT

A holder assembly includes long terminals and a holder that includes long grooves in which the terminals are installed. Each of the long grooves is positioned between sidewalls which stand on both sides of the long groove. Each of the sidewalls includes engagement lock arms at a plurality of places arranged in a longitudinal direction of the long groove. Engagement claws are formed on each of the engagement lock arms.

6 Claims, 9 Drawing Sheets

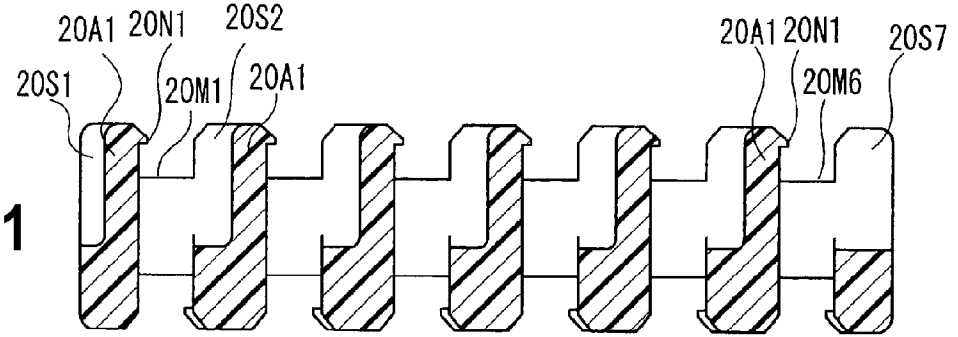
FIG. 2B1
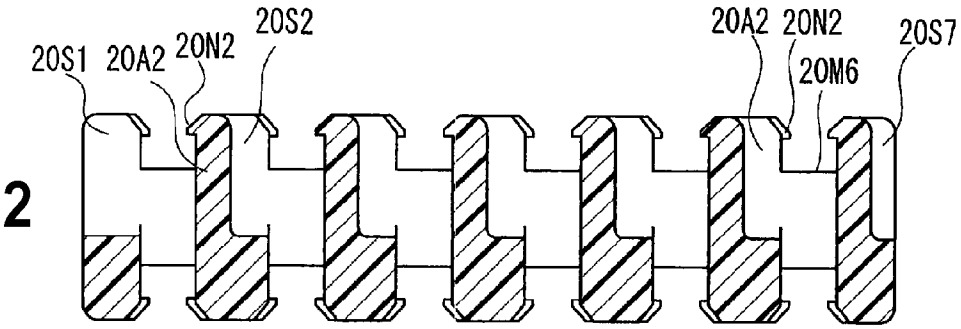
FIG. 2B2
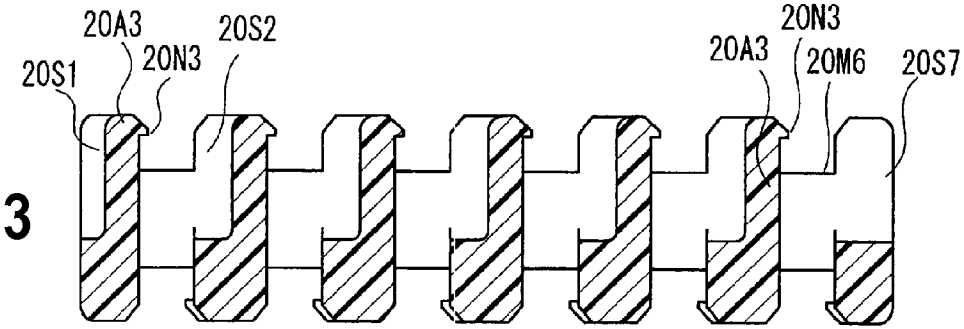
FIG. 2B3

HOLDER ASSEMBLY FOR RELAY CONNECTOR

CROSS REFERENCE TO RELATED APPLICATIONS

This application claims the benefit of Japanese Patent Application No. 2013-156968 filed on Jul. 29, 2013, the contents of which are incorporated herein by reference.

BACKGROUND

1. Field of the Invention

The present invention relates to a holder assembly for a relay connector that is to be mounted, for example, on a casing of an engine, a transmission, a motor, or the like, and through which internal wires are to be connected to external wires.

2. Related Art

Some kinds of relay connectors are formed by holding terminals on the surface side of a non-conductive mounting plate, and then incorporating them into a synthetic resin-made housing by secondary insert molding. A relay connector in which terminals that have not yet been subjected to secondary insert molding can be prevented from being caused to drop off from a holder or deform by an external force, and the reliability of the electrical connection can be improved is disclosed in, for example, JP-A-2012-164520.

In the invention disclosed in JP-A-2012-164520, in order to prevent an external force from being applied to terminals which have not yet been subjected to secondary insert molding from being, to cause the terminals to drop off from a holder or to be deformed, when secondary insert molding is to be performed on a holder assembly in a state where the terminals are held to the holder, a cover is attached to the holder in the state where the terminals are held by the holder, thereby clamping the terminals.

JP-A-2010-272354 discloses an invention in which cost reduction and productivity improvement are enabled in a device connector formed by performing secondary insert molding.

The invention disclosed in JP-A-2010-272354 includes: a primary molding step of molding a primary molded body in which pilot holes are formed in a connector housing; a terminal press-fitting step of press-fitting intermediate terminals into the pilot holes to form an intermediate product; and an insert molding step of setting the intermediate product in a secondary molding die, and molding a device connector. The primary molded body has: a resin inflow opening which, during the secondary molding, allows a resin supplied from a gate to flow through the primary molded body; and a supporting projection which internally contacts the secondary molding die.

According to the configuration, the resin flow during the secondary molding is improved, and the intermediate product is prevented from being positionally displaced, whereby the rate of defective products can be suppressed, and cost reduction and productivity improvement are enabled.

In both the inventions, when the intermediate product is to be subjected to secondary molding by insert molding, however, there is a possibility that dispersion occurs in the resulting performance of the intermediate product, and hence the productivity of the secondary molding is lowered. Moreover, there is still room for improvement in the alignment dimensions of the terminals.

The invention has been conducted in view of the above-discussed circumstances. It is an object of the invention to enable cost reduction and improvement of a product in the case where an intermediate product including intermediate terminals is subjected to secondary insert molding, and more particularly to, in the case where such an intermediate product is to be subjected to secondary molding by insert molding, prevent the productivity of the secondary molding and the correctness of the alignment dimensions of terminals from being reduced due to the resulting performance of the intermediate product.

SUMMARY

In order to achieve the objects, holder assemblies (1) to (3) of the invention are characterized as follows:

(1) a holder assembly configured by long terminals, and a holder including long grooves in which the terminals are installed, respectively, wherein each of the long grooves is positioned between sidewalls which stand on both sides of the long groove, each of the sidewalls includes engagement lock arms in a plurality of places in a longitudinal direction of the long groove, and engagement claws are formed on each of the engagement lock arms;

(2) in the holder assembly according to (1) above, each of the terminals includes a swollen portion which is wide in a lateral direction, in a middle in a longitudinal direction, and the sidewall is cut away in a portion where the swollen portion is located when the terminal is installed in the long groove of the holder; and (3) in the holder assembly according to (1) or (2) above, the engagement lock arm is a part of the sidewall which is obtained by cutting away portions in front and rear of the part of the sidewall leaving the part.

Moreover, a relay connector (4) of the invention is characterized in that the relay connector is obtained by performing secondary molding on any one of the holder assemblies (1) to (3) above, using a molding die.

According to the holder assembly having the configuration of (1) above, each of the engagement lock arm has the engagement claw, and therefore the terminals are surely prevented from popping out upward of the grooves after the terminals are installed in the grooves.

According to the holder assembly having the configuration of (2) above, even when one of the terminals tries to forward or rearward slip off the corresponding groove, the swollen portion butts against the sidewalls, and further movement is blocked. Therefore, the terminal is blocked from slipping off forward or rearward.

According to the holder assembly having the configuration of (3) above, even in the case where the holder is deformed by contraction occurring after primary molding, when the holder is to be set in a molding die in the secondary molding, the holder assembly can follow the shape of the molding die because flexibility is provided by the formation of the cutaways of the holder assembly. Therefore, the setting property is not impaired, and the holder assembly can be smoothly set in the molding die. Consequently, the alignment dimensions of the side which is to be attached to a circuit board can be ensured, and stable alignment dimensions can be ensured.

According to the relay connector having the configuration of (4) above, the relay connector can be obtained by performing secondary molding on any one of the holder assemblies (1) to (3) using a molding die, and therefore the holder assembly can follow the shape of the molding in the secondary molding. Consequently, the setting property is not impaired. As a result, it is possible to obtain a relay connector in which the alignment dimensions of the side which is to be attached to a circuit board is ensured.

According to the invention, after the terminals are installed in the grooves, the terminals are surely blocked from upward popping out.

Even when one of the terminals tries to forward or rearward slip off the corresponding groove, moreover, movement beyond a certain distance is blocked, and hence the terminal is blocked from forward or rearward slipping off.

Even in the case where the holder is deformed by contraction occurring after primary molding, when the holder is to be set in a molding die in the secondary molding, the holder assembly can follow the shape of the molding die. Therefore, the setting property is not impaired, and the holder assembly can be smoothly set in the molding die. Consequently, the alignment dimensions of the side which is to be attached to a circuit board can be ensured, and stable alignment dimensions can be ensured.

As a result, when the holder assembly of the invention is employed in secondary molding of a relay connector using a molding die, the holder assembly can follow the shape of the molding die in the secondary molding, and hence the setting property is not impaired. Consequently, it is possible to obtain a relay connector in which the alignment dimensions of the side to be attached to a circuit board is ensured.

BRIEF DESCRIPTION OF THE DRAWINGS

FIGS. 2B1 to 2B3 are sectional views taking along B1-B1, B2-B2, B3-B3 in FIG. 2A, respectively.

FIG. 3B1 to 3B3 are views illustrating an engaging operation of engagement lock arms in a portion of a block 3B in FIG. 3A.

FIGS. 6-1 to 6-3B are views illustrating secondary molding of the holder assembly of the invention, FIG. 6-1 is a sectional view showing a state before the holder assembly is set in a molding die, FIG. 6-2 is a sectional view showing a state where the holder assembly is set in the molding die, FIG. 6-3A is a plan view of a relay connector which is a completed product of the secondary molding, and FIG. 6-3B is a sectional view taking along 3B-3B in FIG. 6-3A.

DETAILED DESCRIPTION

Hereinafter, the holder assembly of the invention will be described in detail with reference to the drawings.

Figure 1B:
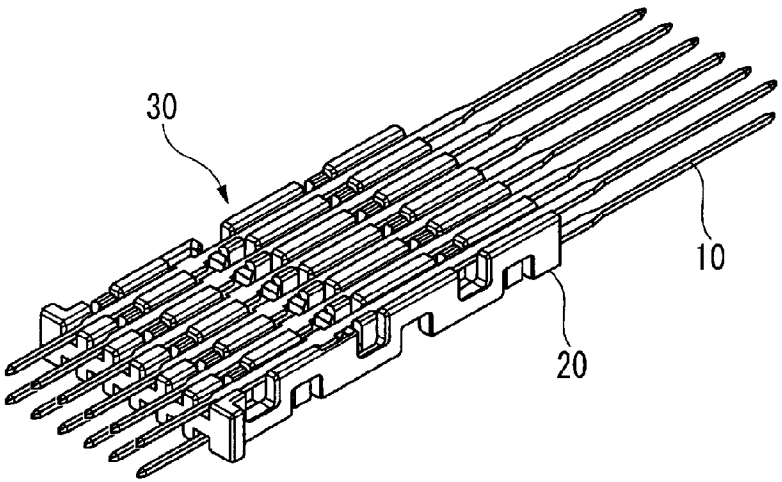
FIG. 1B is a perspective view of the holder assembly in which terminals in FIG. 1A are pressingly held.
Figure 1A:
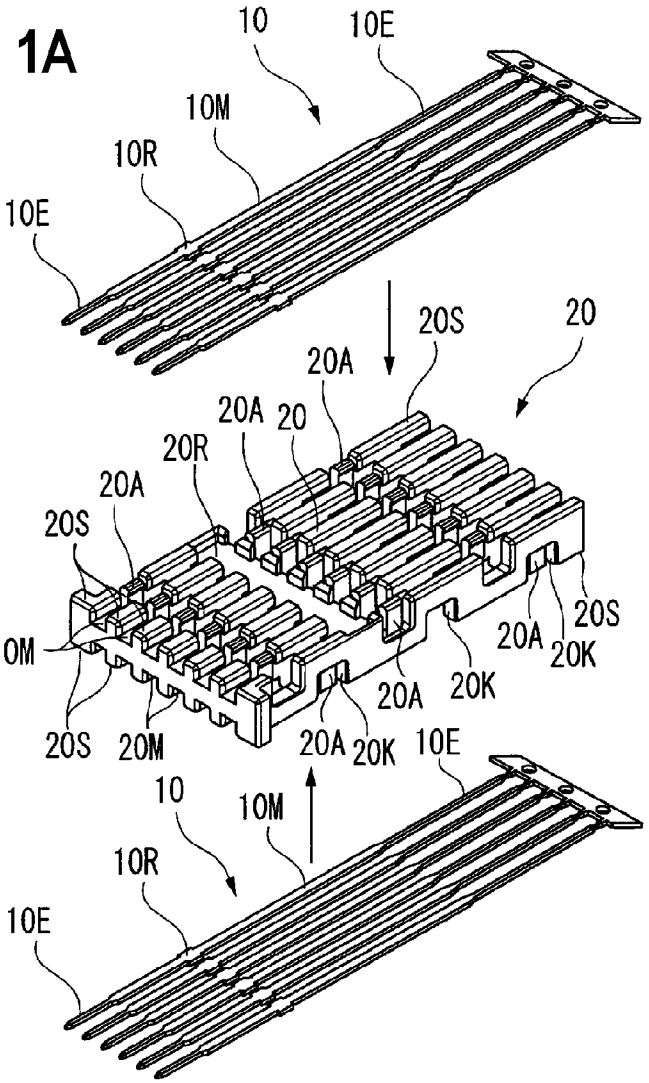
FIG. 1A is an exploded perspective view of the holder assembly of the invention.

FIG. 1A is an exploded perspective view of the holder assembly of the invention, and FIG. 1B is a perspective view of the holder assembly in which terminals in FIG. 1A are installed to a holder.

The holder assembly 30 is configured by two sets of terminals 10 made of an electrically conductive metal, and a holder 20 made of a non-conductive synthetic resin. The terminals 10 are integrally installed by, from the front and rear sides, pressingly holding the terminals into a plurality of grooves 20M which are formed in the front and rear sides of the holder 20.

<Terminals 10>

As shown in FIG. 1A, the terminals 10 which are to be pressingly held on the front side of the holder 20 have the same shape as the terminals 10 which are to be pressingly held on the rear side. All the terminals are made of an electrically conductive metal, and have a linear shape. In each of the linear terminals, a middle portion 10M is a portion which is to be pressingly held by the holder 20, and formed to be slightly larger in width. The ends 10E of the linear terminal are male terminal which are to be inserted into counter female terminals, and formed to be smaller in width than the middle portion 10M. In one place of the middle portion 10M which is wide, a swollen portion 10R which is further wider, and which is rectangular in a plan view is formed. The swollen portion plays a role of a stopper which blocks the terminal 10 from longitudinally moving in the holder 20.

<Holder 20>

Figure 2A:
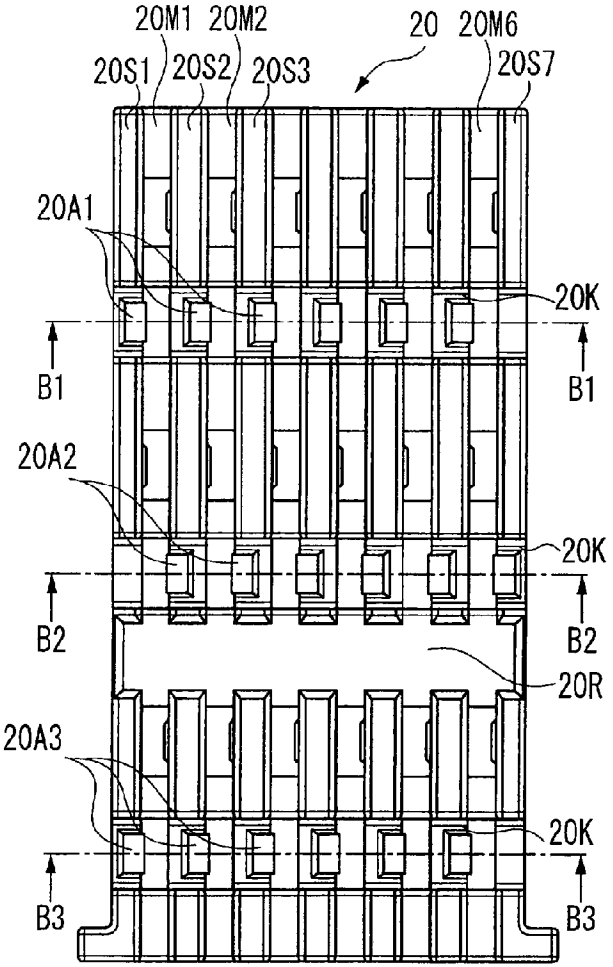
FIG. 2A is a plan view of a holder in the invention.

In the holder 20, the front side (upper side in the figure) and rear side (lower side in the figure) have the same function. Therefore, the shape of only one (front side) of the sides will be described, and the description of that of the other side (rear side) will be omitted. FIG. 2A is a plan view of a holder in the invention. Referring to FIG. 2A, the holder 20 is formed by resin molding. Seven sidewalls 20S which extend in the vertical direction (longitudinal direction) in the figure stand on each of the front and rear sides. The sidewalls are formed at the same positions of the front and rear sides. The long groove 20M into which the corresponding terminal 10 is pressingly held is formed between one of the sidewalls 20S and the adjacent sidewall 20S. In each of the sidewalls 20S, engagement lock arms 20A (20A1, 20A2, 20A3) are formed in three places (portions where cutting plane lines B1, B2, B3 are drawn) in the longitudinal direction, and portions in front and rear of the portions are cut away leaving the engagement lock arms, to be formed as cutouts.

Figures 1, 6:
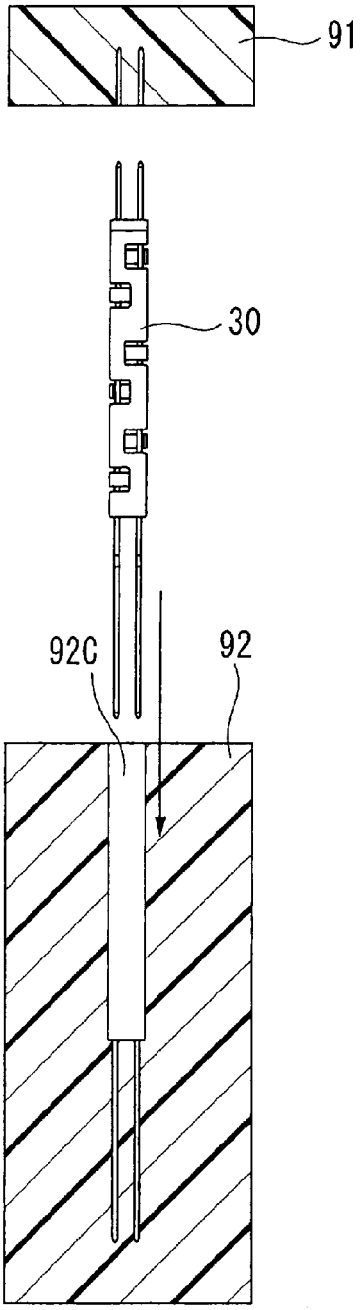

FIGS. 2B1 to 2B3 are sectional views taking along cutting plane lines B1-B1, B2-B2, B3-B3 in FIG. 2A, respectively. Referring to FIGS. 2B1 to 2B3, in each of the engagement lock arms 20A, the sidewall width of the upper half of the corresponding sidewall 20S is reduced to half the original width, so that elasticity is produced by the resilience of the resin itself. An engagement claw 20N which extends in one direction is formed on the tip end of the arm.

The description will be made with reference to a specific example of FIG. 2B1. In one of the engagement lock arms 20A1, the left upper half portion of the sidewall 20S1 (FIG. 2A) is cut out, only the right wall portion remains, and the remaining right wall portion is formed as the engagement lock arm. Since the width of the sidewall is reduced to half the original width, the engagement lock arm 20A1 is provided with elasticity due to the resilience of the resin material itself. The engagement claw 20N1 is formed on the right side of the top portion of the engagement lock arm 20A1.

Also the other engagement lock arms 20A1 which are on the cutting plane line B1-B1 have the same shape.

Figures 2, 6:
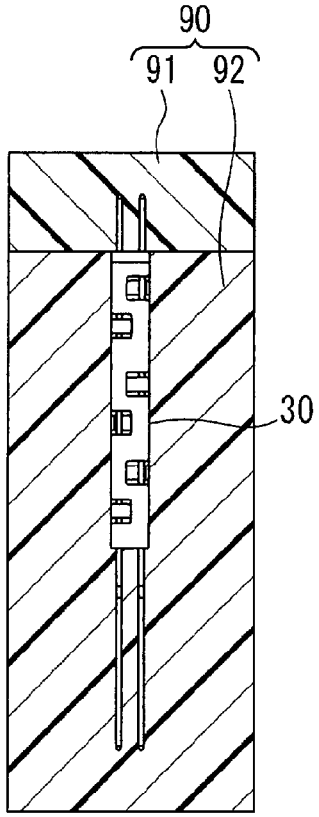
Figures 3A, 6:
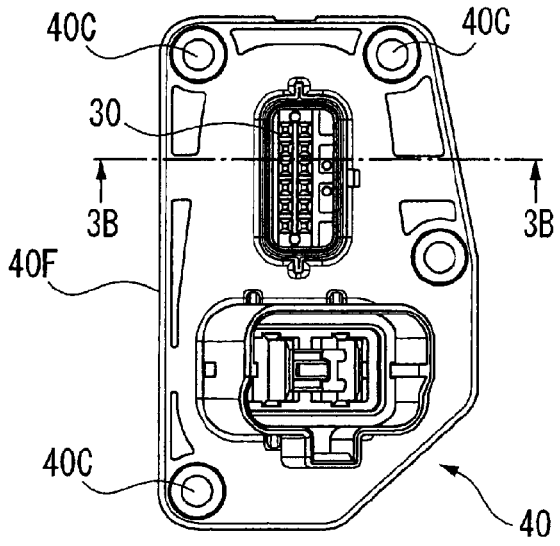

In FIG. 2B2, in one of the engagement lock arms 20A2, the right upper half portion of the sidewall 20S1 (FIG. 2A) is cut out, only the left wall portion remains, and the remaining left wall portion is formed as the engagement lock arm. Similarly, the engagement lock arm 20A2 is provided with elasticity. The engagement claw 20N2 is formed on the left side of the top portion of the engagement lock arm 20A2.

Also the other engagement lock arms 20A2 which are on the cutting plane line B2-B2 have the same shape.

The engagement lock arms 20A3 of FIG. 2B3 have the same shape as the engagement lock arms 20A1. Therefore, the engagement lock arms are similarly provided with elasticity, and the engagement claws 20N3 are formed on the right sides of the top portions of the engagement lock arms 20A3, respectively.

As described above, according to Embodiment 1 of the invention, the engagement claws 20N1, 20N3 of the engagement lock arms 20A1, 20A3 are located on the right side, and the engagement claws 20N2 of the engagement lock arms 20A2 are located on the left side. According to the configuration, the terminals are blocked from upward popping out by the engagement lock arms in the following manner.

<Embodiment 1: Blocking of Popping Out of Terminals by Engagement Lock Arms>

Next, the operation of blocking the terminals from popping out by the engagement lock arms in Embodiment 1 of the invention will be described with reference to FIGS. 3A and 3B.

Figure 3A:
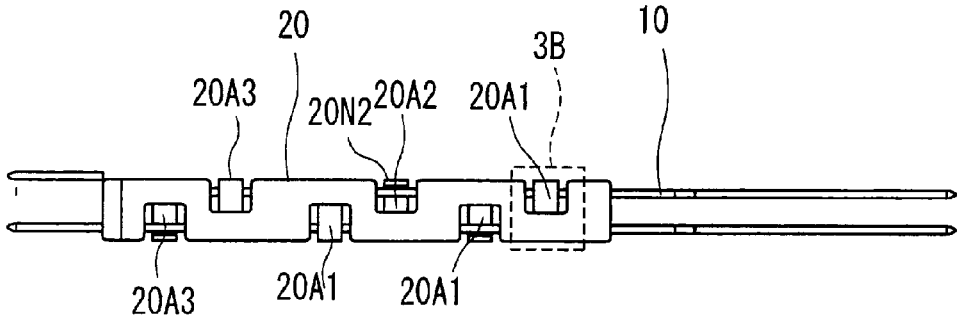
FIG. 3A is a front view of the holder assembly of the invention.
Figure 3A:
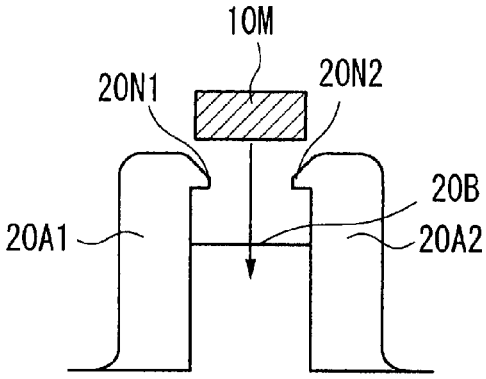
Figure 3A:
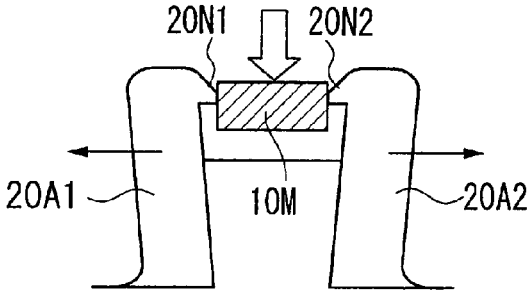
Figure 3A:
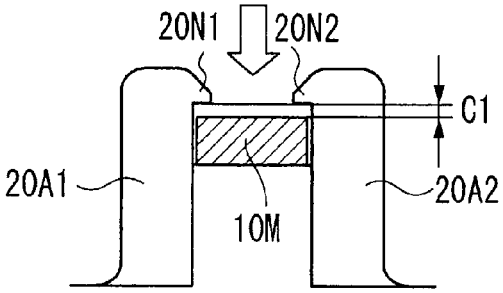

With respect to the engagement lock arms, as described above, the engagement lock arms 20A1, 20A2, 20A3 are formed in the three places of each of the sidewalls of the front side of the holder 20 shown in FIG. 3A. In the top portions of the engagement lock arms 20A1, 20A2, 20A3, the engagement claws 20N1, 20N2, 20N3 are formed on one side surface, respectively. The engagement claws 20N1, 20N3 of the engagement lock arms 20A1, 20A3 are formed on the same side surfaces of the top portions, and the engagement claws 20N2 are formed on the opposite side surfaces of the top portions.

A case will be considered where the middle portion 10M (FIG. 1A) of one of the terminals 10 is to be pressingly held into the long groove 20M1 between the engagement lock arm 20A1 of the sidewall 20S1 (FIG. 2B1) and the engagement lock arm 20A2 of the sidewall 20S2 (FIG. 2B1) which is right adjacent to the sidewall 20S1. As shown in FIG. 3B1, the middle portion 10M approaches the engagement claw 20N1, 20N2 of the engagement lock arms 20A1, 20A2, and butts against inclined surfaces formed on the engagement claw 20N1 and the engagement lock arm 20A2, to press apart the engagement claw and the arm. As shown in FIG. 3B2, the middle portion then passes through the space between the engagement claws 20N1, 20N2 of the engagement lock arms 20A1, 20A2, and finally butts against the bottom 20B of the holder to stop further movement as shown in FIG. 3B3. At this time, the engagement lock arms 20A1, 20A2 are caused to return to their original shapes by the resilience of the resin itself, and the engagement claws 20N1, 20N2 cooperate to prevent the middle portion 10M from returning to its original position.

Although in the above the engagement lock arm 20A3 has not been described, the engagement lock arm operates in the same manner as the engagement lock arm 20A1.

A clearance C1 is disposed between the middle portion 10M and the engagement claw 20N1 (engagement claw 20N2), so that the terminal 10 is allowed to somewhat freely move in the upward direction.

<Embodiment 2: Blocking of Terminals From Slipping Off in Front-Back Direction>

Figure 4B:
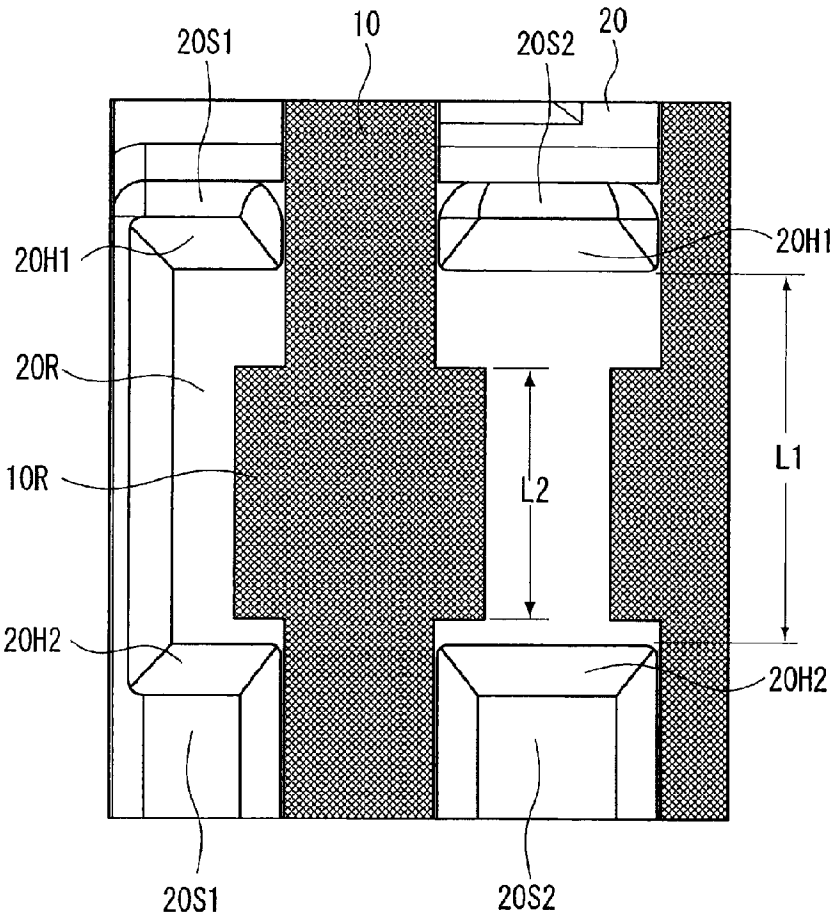
FIG. 4B is an enlarged view of a block 4B in FIG. 4A.

Next, a structure for blocking the terminals from slipping off in the front-back direction in Embodiment 2 of the invention will be described with reference to FIGS. 4A and 4B.

Figure 4A:
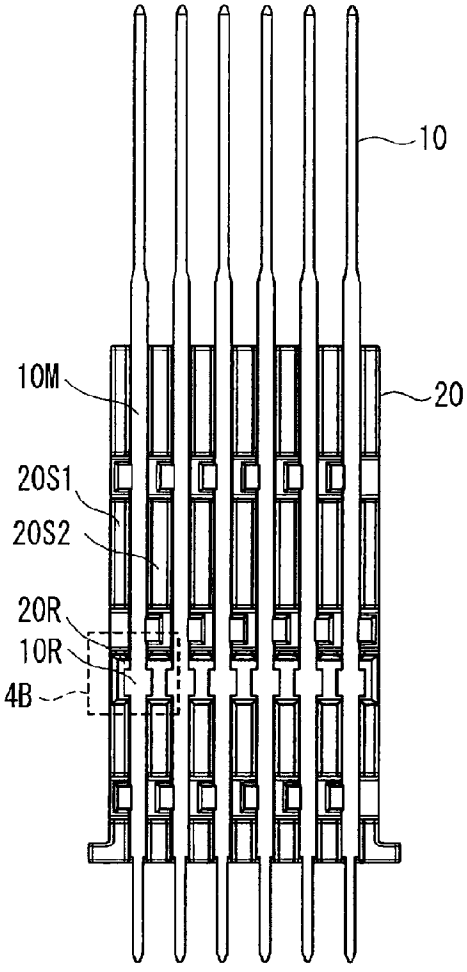
FIG. 4A is a plan view of terminals in the invention.

Referring to FIG. 4A, in one place of the middle portion 10M of each of the terminals 10, as described above, the rectangular swollen portion 10R which is wider is formed. Accommodating spaces 20R for accommodating the swollen portions 10R are formed in the holder 20 as shown in FIG. 4B.

<Accommodating spaces 20R for swollen portions 10R>

The sidewalls 20S1, 20S2 of the holder 20 which exist in a portion where the rectangular swollen portion 10R of each of the terminals 10 are vertically cut out in front and rear of the swollen portion 10R, whereby one of the accommodating spaces 20R is formed. Vertical walls 20H1 are formed in the front side of the accommodating space 20R, and other vertical walls 20H2 are formed in the rear side of the accommodating space 20R.

When the terminal 10 tries to forward slip off, therefore, the front end of the swollen portion 10R butts against the vertical walls 20H1, and further movement is blocked, so that forward slipping off of the terminal is blocked.

When the terminal 10 tries to rearward slip off, similarly, the rear end of the swollen portion 10R butts against the vertical walls 20H2, and further movement is blocked, so that also rearward slipping off of the terminal is blocked.

In Embodiment 2, in this way, the terminals are blocked from slipping off in the front-back direction.

<Clearance in Front-Back Direction of Terminal>

The distance between the vertical walls 20H1, 20H2 is indicated by L1, and the length of the longitudinal side of the rectangular swollen portion 10R is indicated by L2. Since the dimensions are set so that a clearance C2=L1−L2 is attained. The terminal 10 can freely move within the range of the clearance C2.

As described above, the terminals 10 are blocked from being slipping off in the front-back direction, but can freely move within the range of the clearance C1 in the vertical direction and that of the clearance C2 in the front-back direction.

<Embodiment 3: Flexibility of Holder Assembly 30>

In Embodiment 3, the holder assembly 30 is provided with flexibility which allows the holder assembly to vertically deflect in the longitudinal direction, in the following manner.

Figure 5A:
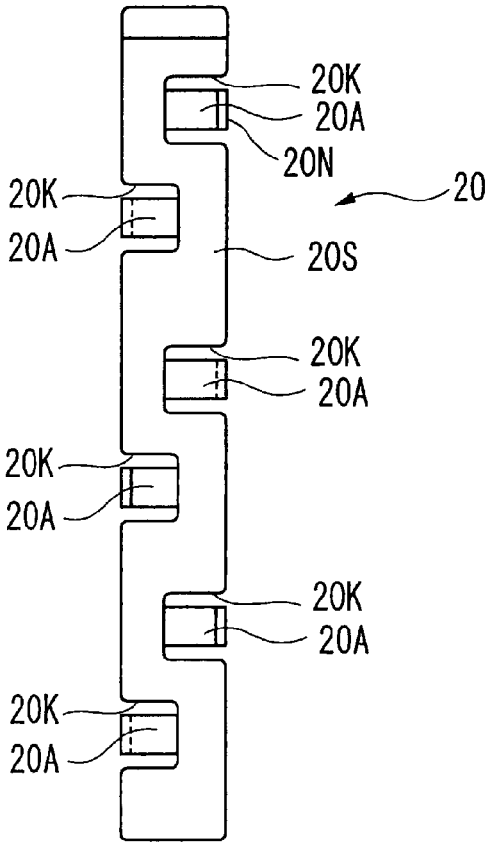
FIG. 5A is a front view of a holder in the invention.
Figure 5B:
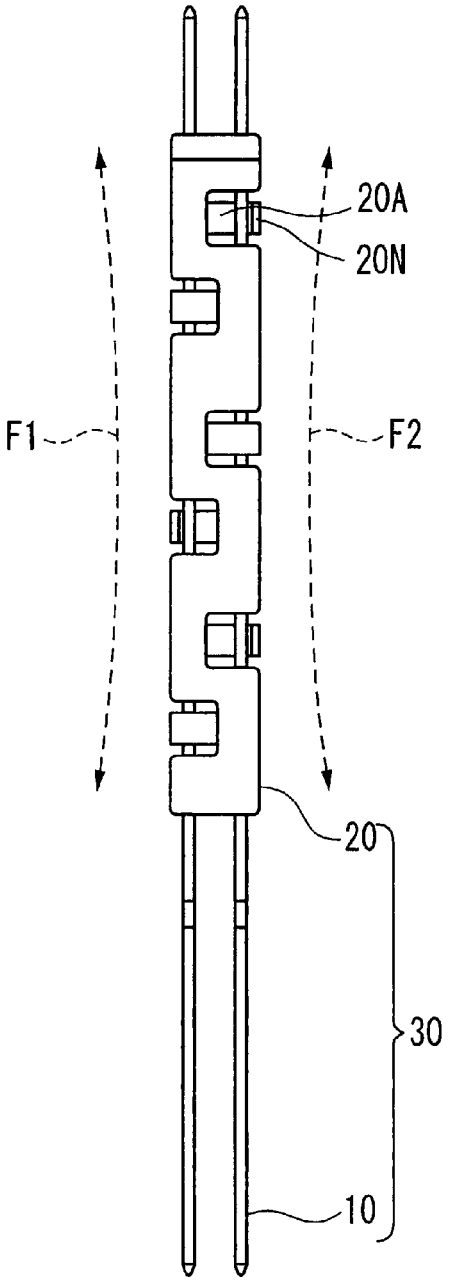
FIG. 5B is a front view illustrating the flexibility of a holder assembly in which the holder is used.

FIG. 5A is a front view of a holder in the invention, and FIG. 5B is a front view illustrating the flexibility of a holder assembly in which the terminals are incorporated into the holder of FIG. 5A. Referring to FIG. 5A, in the holder 20, the engagement lock arms 20A are alternately formed in the front and rear sides at predetermined intervals in the longitudinal direction of the sidewalls 20S, and cutaways 20K are formed by cutting out walls in the peripheries of the engagement lock arms 20A. The holder assembly 30 configured by pressingly holding the terminals 10 in the holder 20 in which the cutaways 20K are formed in a plurality of places of the front and rear sides as described above is allowed to deflect in flexible directions F1, F2 in FIG. 5B, by the cutaways 20K that are formed in the front and rear sides.

When the holder assembly 30 is set in a molding die in the secondary molding which will be described below, therefore, the holder assembly 30 can follow the shape of the molding die, and therefore stable alignment dimensions can be ensured.

<Secondary Molding of Holder Assembly 30>

Next, the procedure of setting the flexible holder assembly in a molding die, and performing secondary molding to obtain a relay connector will be described. FIGS. 6-1 to 6-3B are views illustrating secondary molding (insert molding) of the holder assembly of the invention, FIG. 6-1 is a sectional view showing a state before the holder assembly is set in the molding die, FIG. 6-2 is a sectional view showing a state where the holder assembly is set in the molding die, FIG. 6-3A is a plan view of the relay connector which is a completed product of the secondary molding, and FIG. 6-3B is a sectional view taking along 3B-3B in FIG. 6-3A.

Referring to FIG. 6-1, the holder assembly 30 (FIG. 5B) is accommodated in a holder assembly accommodating portion 92C of a lower die 92, and an upper die 91 is placed on the lower die 92 to configure a molding die 90 as shown in FIG. 6-2. The molding die 90 is filled with a synthetic resin, and the relay connector 40 which is a secondary molding product is obtained.

At this time, even in the case where the holder 20 (FIG. 5A) is deformed by contraction of the holder 20 occurring after primary molding, when the holder is to be set in the molding die, the holder assembly 30 of FIG. 5B can follow the shape of the molding die because the holder assembly 30 is provided with flexibility by the formation of the cutaways 20K. Therefore, the setting property is not impaired, and the holder assembly can be smoothly set in the molding die. Consequently, the alignment dimensions of the side which is to be attached to a circuit board can be ensured, and stable alignment dimensions can be ensured.

In this way, secondary molding can be performed stably and surely, and the relay connector 40 of FIG. 6-3A is obtained. The relay connector 40 is made of a non-conductive synthetic resin which contains the holder assembly 30 of the invention and a connector 32 for another system, and includes a mounting flange 40F and collars 40C.

Figures 3B, 6:
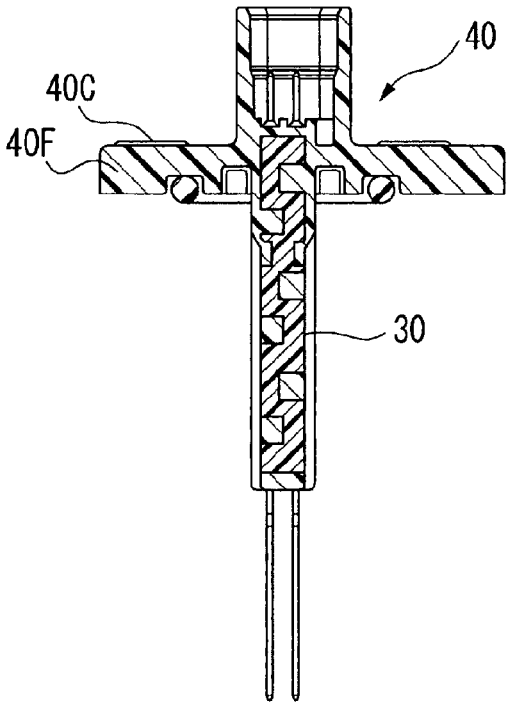

As described above, even when the holder before secondary molding is deformed in the direction of F1 or F2 (FIG. 5B), the holder assembly 30 in the relay connector 40 after secondary molding is formed as a molded product which follows the molding die as shown FIG. 6-3B, because of the flexibility of the holder assembly 30.

<Relay Connector>

Figure 7A:
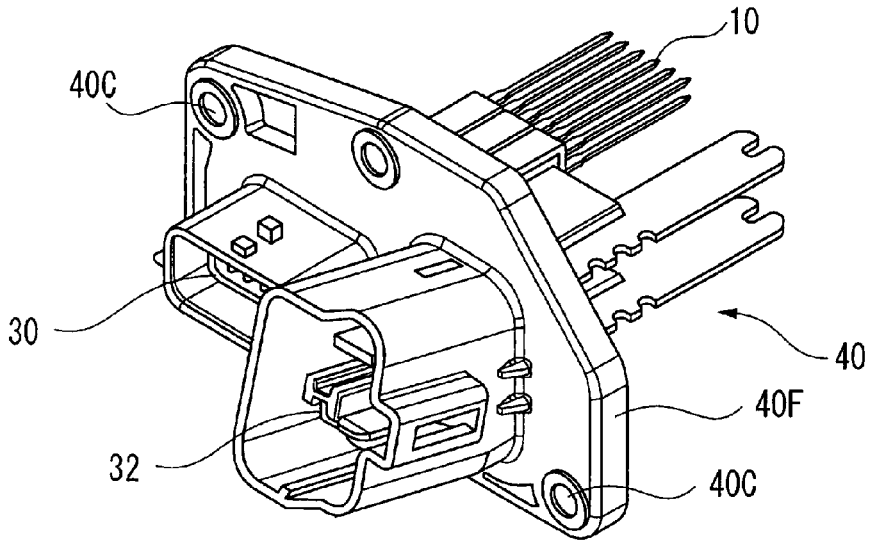
FIG. 7A is a perspective view of the relay connector of FIG. 6-3A.
Figure 7B:
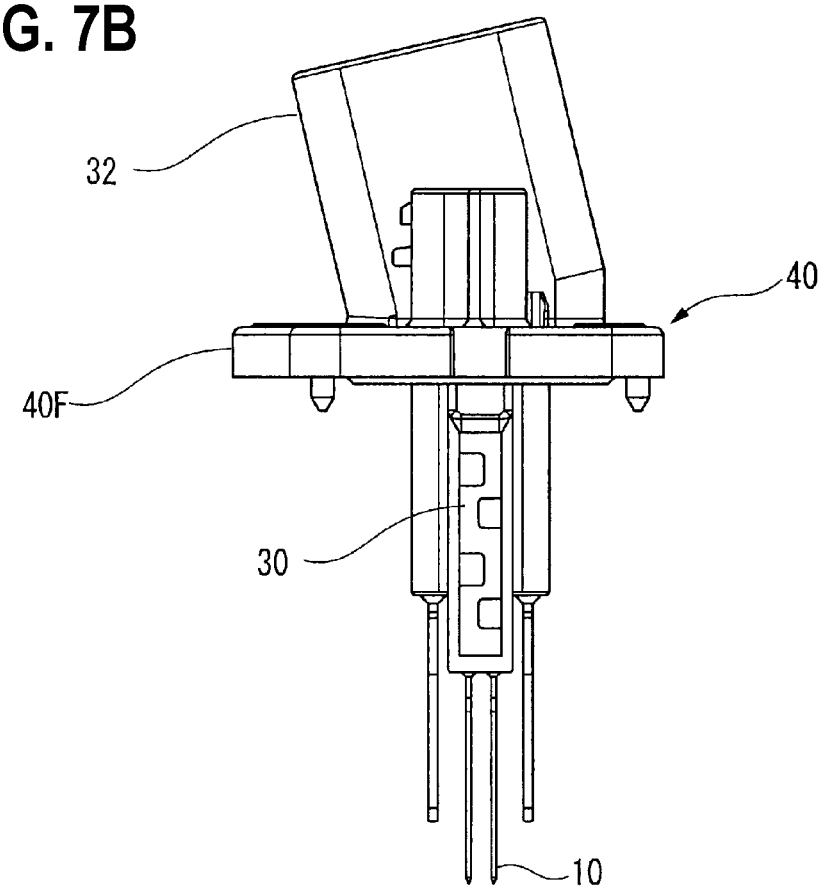
FIG. 7B is a front view of the relay connector.

FIG. 7A is a perspective view of a relay connector which is obtained by performing secondary molding on the holder assembly of the invention, and FIG. 7B is a front view of the relay connector. The relay connector 40 is a connector which is to be attached to a mounting hole of a casing of an engine, a transmission, a motor, or the like, and through which an internal cable in the casing is to be electrically connected to an external cable outside the casing. The relay connector 40 contains the holder assembly 30 of the invention and the connector 32 for another system, and includes the flange 40F. The flange 40F is a portion to which bolts are to be fastened in the case where the relay connector 40 is attached to the mounting hole of the casing, and includes the plurality of collars 40C in the peripheral edge. The collars 40C are formed by a hard metal or the like, and used for, when the flange 40F is fastened to the casing, preventing a strong fastening force from being applied to the flange 40F, thereby protecting the flange 40F.

<Summary>

According to the thus configured holder assembly, each of the engagement lock arms have the engagement claw, and therefore the terminals are surely prevented from popping out upward of the grooves after the terminals are installed in the grooves.

Even when one of the terminals tries to forward or rearward slip off the corresponding groove, the swollen portion butts against the sidewalls, and further movement is blocked. Therefore, the terminal is blocked from slipping off forward or rearward.

Even in the case where the holder is deformed by contraction occurring after primary molding, when the holder is to be set in the molding die in the secondary molding, the holder assembly can follow the shape of the molding die because flexibility is provided by the formation of the cutaways of the holder assembly. Therefore, the setting property is not impaired, and the holder assembly can be smoothly set in the molding die. Consequently, the alignment dimensions of the side which is to be attached to a circuit board can be ensured, and stable alignment dimensions can be ensured.

From the above, when the holder assembly of the invention is employed in a process in which the holder assembly is subjected to secondary molding with a molding die to produce the relay connector, the holder assembly of the invention can follow the shape of the molding die in the secondary molding, and hence the setting property is not impaired. Consequently, it is possible to obtain a relay connector in which the alignment dimensions of the side to be attached to a circuit board is ensured.

What is claimed is:

1. A holder assembly comprising:
long terminals; and
a holder that includes long grooves in which the terminals are installed,
wherein each of the long grooves is positioned between sidewalls which stand on both sides of the long groove,
each of the sidewalls includes engagement lock arms at a plurality of places arranged in a longitudinal direction of the long groove,
engagement claws are formed on each of the engagement lock arms;
each of the terminals includes a swollen portion which has a width wider than other part of the terminals in a lateral direction of the terminals, at a middle portion of the terminals in a longitudinal direction of the terminals, and
the sidewall is cut away in a portion where the swollen portion is located when the terminal is installed in the long groove of the holder.

2. The holder assembly according to claim 1, wherein the engagement lock arm is a part of the sidewall which is left when portions in front and rear of the part of the sidewall are cut.

3. The holder assembly according to claim 1, wherein the engagement lock arm is a part of the sidewall which is left when portions in front and rear of the part of the sidewall are cut.

4. A relay connector which is obtained by performing secondary molding on a holder assembly according to claim 1, using a molding die.

5. A holder assembly comprising:
long terminals; and
a holder that includes long grooves in which the terminals are installed,
wherein each of the long grooves is positioned between sidewalls which stand on both sides of the long groove,
each of the sidewalls includes engagement lock arms at a plurality of places arranged in a longitudinal direction of the long groove,
engagement claws are formed on each of the engagement lock arms; and
the engagement lock arm is a part of the sidewall which is left when portions in front and rear of the part of the sidewall are cut.

6. A holder assembly and relay connector, the holder assembly comprising:
long terminals; and
a holder that includes long grooves in which the terminals are installed,
wherein each of the long grooves is positioned between sidewalls which stand on both sides of the long groove,
each of the sidewalls includes engagement lock arms at a plurality of places arranged in a longitudinal direction of the long groove, engagement claws are formed on each of the engagement lock arms; and the relay connector is obtained by performing secondary molding on the holder assembly, using a molding die.

* * * * *